United States Patent [19]

Melton et al.

[11] 4,263,573

[45] Apr. 21, 1981

[54] THERMAL SWITCH WITH A VITREOUS METAL ALLOY SWITCHING ELEMENT

[75] Inventors: Keith Melton, Busslingen; Olivier Mercier, Ennetbaden, both of Switzerland

[73] Assignee: Brown, Boveri & Cie Aktiengesellschaft, Mannhiem, Fed. Rep. of Germany

[21] Appl. No.: 971,340

[22] Filed: Dec. 20, 1978

[30] Foreign Application Priority Data

Dec. 21, 1977 [CH] Switzerland ..... 15758/77

[51] Int. Cl.[3] ..... H01H 61/04; H01H 61/06

[52] U.S. Cl. ..... 337/140; 337/291; 75/123 B; 75/123 D; 75/175.5

[58] Field of Search ..... 337/140, 290, 159, 291–295, 337/165; 75/123 B, 123 D, 175.5

[56] References Cited

U.S. PATENT DOCUMENTS 3,559,120 1/1971 Myers ..... 335/42

4,085,396 4/1978 Augis et al. ..... 337/290

*Primary Examiner*—Harold Broome

*Attorney, Agent, or Firm*—Herbert L. Lerner

[57] ABSTRACT

Thermal switch, including a switching element formed of a coherently structured vitreous metal alloy. The switching element being in a vitreous-amorphous state and having a higher strength at a lower first temperature range, and in a crystalline state and having a lower strength at a higher second temperature range. A tensioning device cooperating with the switching element for exerting a force thereon which is sufficient to break the switching element in the crystalline state and insufficient to break the switching element in the vitreous amorphous state. A device for triggering a switching process in response to the breaking of the switching element in the vicinity of a transition from the first to the second temperature range. An exchangeable cassette assembly for housing the switching element, and a method for protecting circuits against overcurrents using the thermal switch.

28 Claims, 6 Drawing Figures

THERMAL SWITCH WITH A VITREOUS METAL ALLOY SWITCHING ELEMENT

Figure 1A:
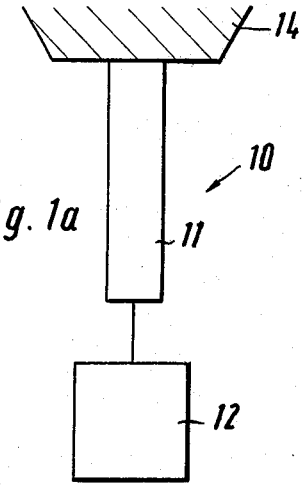

The invention relates to a thermal switch with an element triggering the switching process of a material which suffers a change of state when a certain temperature value is exceeded. The invention relates further to a method for protecting circuits against overcurrents.

Known thermal switches in which the element triggering the switching process consists of a material which exhibits a change of state when a given temperature value is exceeded, are the conventional fuses, i.e. switches with an element of a metal which melts at relatively low temperatures (solid/liquid conversion), which triggers the switching process, usually the interruption of an electrically overloaded circuit. Known are further the switches based on the use of so-called form memory alloys (U.S. Pat. Nos. 3,285,470, 3,516,082 and 3,652,969 as well as German Published, Non-Prosecuted Applications Nos. 2,026,629 and 2,139,852), in which the switching element suffers at a given temperature a Martensite/Austenite conversion (solid/solid) of the metal lattice and can therefore thereby change its external shape suddenly.

One advantage of thermal switches, of which the element triggering the switching process consists of a form memory alloy, over fuses is based on the difference of the solid/liquid and the solid/solid change of state because it is possible to connect a switching element consisting of a form memory alloy to a tensioning device, and to therefore release in the switching process a force stored, for instance, in a spring used as the tensioning device and use it for reinforcing or accelerating the switching process which is practically impossible in the case of switching elements with solid/liquid conversion. In fuses such reinforcement or acceleration is practically impossible for the reason that the switching element has too low a strength or creep resistance and would therefore change also in the solid state already under the action of moderate mechanical stresses.

While the strength or creep resistance of form memory alloys is better than that of the metals or alloys which are suitable for fuses it would be desirable, apart from the desirability of further increased strength of the material used for the element triggering the switching process if the temperature at which the change of state takes place were not limited to the relatively low temperature range of the Maretensite/Austenite conversion of the form memory alloys.

It has been found that the conversion characteristics of a relatively new group of materials, the so-called "metallic glasses" offer the possibility to eliminate or reduce the limitations connected with the materials known for use in thermal switches. These metallic glasses as well as their preparation and their properties are described in the literature (see G. Taylor and D. Taylor in New Scientist of Aug. 12, 1976, pages 323–325; H. A. Davies & H. Jones in Metals and Material, June 1976, pages 44–45; D. E. Polk et al in Materials Sc. and Eng., 23/1976/306–316 and E. Coleman, Mat. Sc. and Eng. 23/1976/ 161 ff) as metal alloys which can be maintained in an amorphous vitrious state by extremely fast quenching from the melted state, and have in this state substantially higher strength or hardness properties and better corrosion resistance than in the crystalline state. Several applications, for instance as reinforcement inserts in plastic materials, for magnetic materials and for sharp cutting tools (German Published, Non-Prosecuted Applications Nos. 2,602,555) have already been proposed. In some of the proposed applications, however, the fact is a problem that the amorphous vitreous or boundary free state merges practically irreversibly into the normal crystalline state (reappearance of grain boundaries) at the recrystallization temperature, which can be, for instance, in the range of 200°–700° C., which goes along with considerable reductions in strength.

Surprisingly, it has been found that just these properties of the metallic glasses which are frequently of disadvantage for application, make possible great advantages if these materials are used as elements of thermal switches of the type mentioned at the outset.

The thermal switch according to the invention is characterized by the feature that the element triggering the switching process is a coherent structure of a vitreous metal alloy which has in a first lower temperature range a vitreous amorphous state, and in a second higher temperature a crystalline state and the strength of which is, in the vitreous-amorphous state, higher than in the crystalline state; and that the tensioning device cooperating with the element brings to bear on the element a force which is larger than the force required for breaking the element in the crystalline state and smaller than the force required for breaking the element in the vitrious-amorphous state, so that the element is broken by the tensioning device at a temperature in the vicinity of the transition from the first to the second temperature range, for triggering the switching process.

The method according to the invention for protecting circuits against overcurrents is characterized by the use of such a thermal switch as a non-resettable main fuse together with at least one resettable series fuse of the conventional type, for instance a bimetal or magnet coil breaker.

Vitrious metal alloys which are suitable for thermal switches according to the invention are available in technical form, for instance from the firm Allied Chemical Corporation, Morristown, New Jersey, USA, under the trademark "Metglas" in the form of ribbons. These ribbons, for instance, with thicknesses of about 0.03 to about 0.15 mm and widths of about 1 to about 6 mm, can be used directly as coherent structures with lengths of several millimeters up to several centimeters for the thermal switch according to the invention. However, ribbon shape of the coherent structure is not critical. Wires, small plates or leaves of vitreous metal alloy are suitable as the coherent structure.

Typical vitreous metal alloys suitable for the invention consists of an undercooled melt which contains for instance a total of 65 to 80 atom % iron and/or nickel and a total of 18 to 22 atom % boron and/or phosphorous as well as, optionally, in addition one of the elements chromium, molybdenum or aluminum, for instance, with contents of about 14 atom-% Cr, 2 atom-% Mo or 3 atom-% Al. Other vitreous metal alloys suitable here and available in technical form consist substantially of beryllium, zirconium and titanium.

Specific examples of such alloys are given in the following table together with the alloy numbers of the manufacturer mentioned.

| Alloy composition (atom - %) | | | | | | | | | Designation |
|---|---|---|---|---|---|---|---|---|---|
| Fe | Ni | Cr | Mo | Be | Zr | Ti | P | B | "Metglas" |
| 40 | 40 | | | | | | 14 | 6 | 2826 |
| 32 | 36 | 14 | | | | | 12 | 6 | 2826A |
| 80 | | | | | | | | 20 | 2605 |
| 78 | | | 2 | | | | | 20 | 2605A |
| | | | | 40 | 10 | 50 | | | 2204 |

Further specific examples of such metal alloys can be found in the above-named publications by Coleman ($Ni_{75}Al_3P_{16}B_6$ or/and to $Fe_{44.7}Ni_{31.3}Al_3P_{16}B_6$; indexes=atom-%) as well as in the German Published, Non-Prosecuted Application No. 2,602,555.

The tensile strength values of vitreous metal alloys in the vitreous-amorphous state are typically in the range of 1500 to 3000 MPa (1MPa=0.1 kg/mm$^2$) or higher; the respective value can be influenced by post-treatments such as aging, polishing and alike. Thus, for instance, a raw tensile strength value of 1725 MPa is given for the above-mentioned alloy "Metglas" 2605 and a corresponding value of 3153 MPa for material with the edges polished. The recrystallization temperatures typically lie in the range of 300° to 400° C. (for instance 295° C. for "Metglas" 2826A or 390° C. for "Metglas" 2605), but they can also be higher and, in the specific alloys described by Coleman, be about 700° C. The above-mentioned general temperature range of about 200° to 700° C. is considered as typical for most of the known vitreous metal alloys.

Exact values for the corresponding strength values of these alloys after crystallization (appearance of grain boundaries) cannot always be given since this parameter can be influenced by the specific metallurgical situation such as grain size, grain growth and alike, ie. among other things by the rate of crystallization or thermal post-treatments. Practical tests confirm however that the theoretically expected strength reduction due to crystallization takes place in general in jump-fashion, is very considerable and can be, for instance, 75 to 90% or more, i.e. the tensilestrength of these alloys in the crystalline state is only 25% or less of the tensile strength of the amorphous-vitreous state.

For the invention it is in general advisable if the force exerted by the tensioning device on the coherent structure which is used as the element of a thermal switch and triggers the switching process is considerably larger than is required for breaking the structure per se, so that the switching process can be reinforced or accelerated by the excess force. Therefore, if for instance a force corresponding to about one quarter of the tensile strength in the vitreous-amorphous state of the alloy would be sufficient for breaking the structure in the crystalline state, the tensioning device, according to one preferred embodiment of the invention, would exert a force two to three times larger on the coherent structure of the vitreous metal alloy, for instance 30 to 90% and preferably 50 to 75% of the tensile strength value, expressed in Megapascal, of the vitreous metal alloy in the vitreous-amorphous state.

Such a force reserve of the tensioning device, designed for instance as a tension spring, of switches in accordance with the invention is advantageous for the reasons mentioned and is also unobjectionable because of the extremely high creep strength, in typical cases, of vitreous metal alloys in the vitreous-amorphous state. Thus, an elongation of only 0.38% is observed for the above-mentioned technically available metal alloy "Metglas" 2605A ($Fe_{78}Mo_2B_{20}$) with a raw tensile strength in the vitreous amorphous state of 2725 MPa with an applied tension of 1380 MPa (corresponding to 50% of the raw tensile strength) after $3.6 \cdot 10^6$ seconds (manufacturer's data), and for the likewise above-mentioned alloy "Metglas" 2826A ($Fe_{32}Ni_{36}Cr_{14}P_{12}B_6$), the value of the creep strength given is 0.65% at 1380 MPa and 200° C. after $3.6 \cdot 10^6$ seconds. From the above-mentioned reasons of switching reinforcement it will be understood that these very low creep values of the vitreous-amorphous metal alloys can be utilized for thermal switches according to the invention to great advantage for their operation.

It is advisable to check the value of the transition temperature from the vitreous-amorphous to the crystalline state, which is important for the switching temperature of thermal switches according to the invention, i.e. the crystallization temperature of the metal alloy used, examined by a simple load test described further on even if the respective data is available from the manufacturer, because sometimes different evaluation criteria are used.

Although the electric conductivity of vitreous metal alloys is usually lower than that of alloys of similar nature in the crystalline state it is in general in the range typical for metallic conductors; for instance, the resistivity of the technical alloy "Metglas" 2826A is 1.8$\mu$ $\Omega$/meter. Accordingly, the element of vitreous metal alloy triggering the switching process in thermal switches according to the invention can be inserted directly into a circuit which is to be protected against overcurrent; this can be done as desired together with the tensioning device which is accordingly made conductive, or without the latter in order to break the circuit under the action of the tensioning device and to interrupt the circuit permanently if currents occur which convert the element from the vitreous-amorphous metal alloy into the crystalline state through Joule heat.

However, the passage of the current through the element triggering the switching process is only advantageous but not critical since the heating which causes the rupture of the element cooperating with the tensioning device can be transmitted to the element also through a thermal contact or by convection.

The tensioning device is preferably a tensile stress device, for instance a mechanical or nonmechanical spring, for instance, a metal or steel spring or a weight; but power storing devices can also be used which bring another form of mechanical tension to bear on the structure of the vitreous-amorphous metal alloy.

As is customary in the case of conventional melting fuses, the thermal switches according to the invention can also be used for the protection of electric circuits together with a resettable series fuse. However, the possible applications of thermal switches according to the invention are not limited to electric circuits but also include the tripping of purely mechanical, pneumatic or hydraulic systems which are to be protected against overheating or switched-on by overheating such as in fire quenching installations.

Figure 1B:
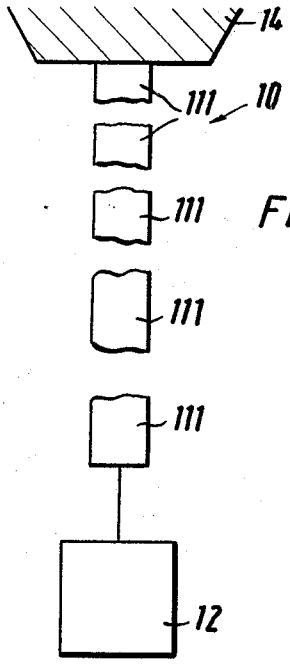
Figure 2:
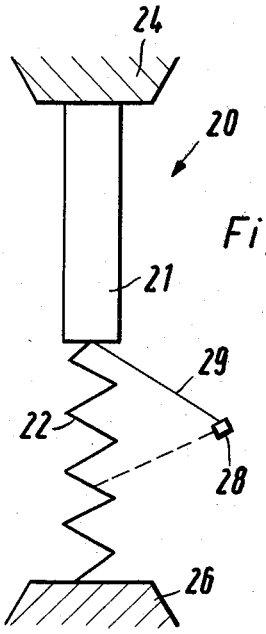
Figure 3:
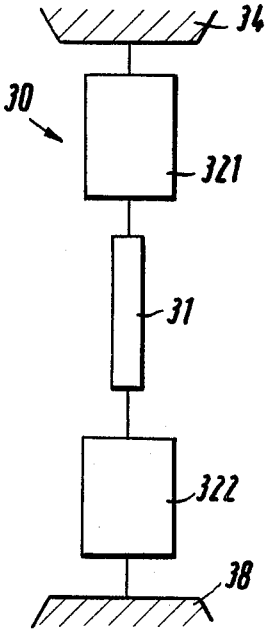
Figure 4:
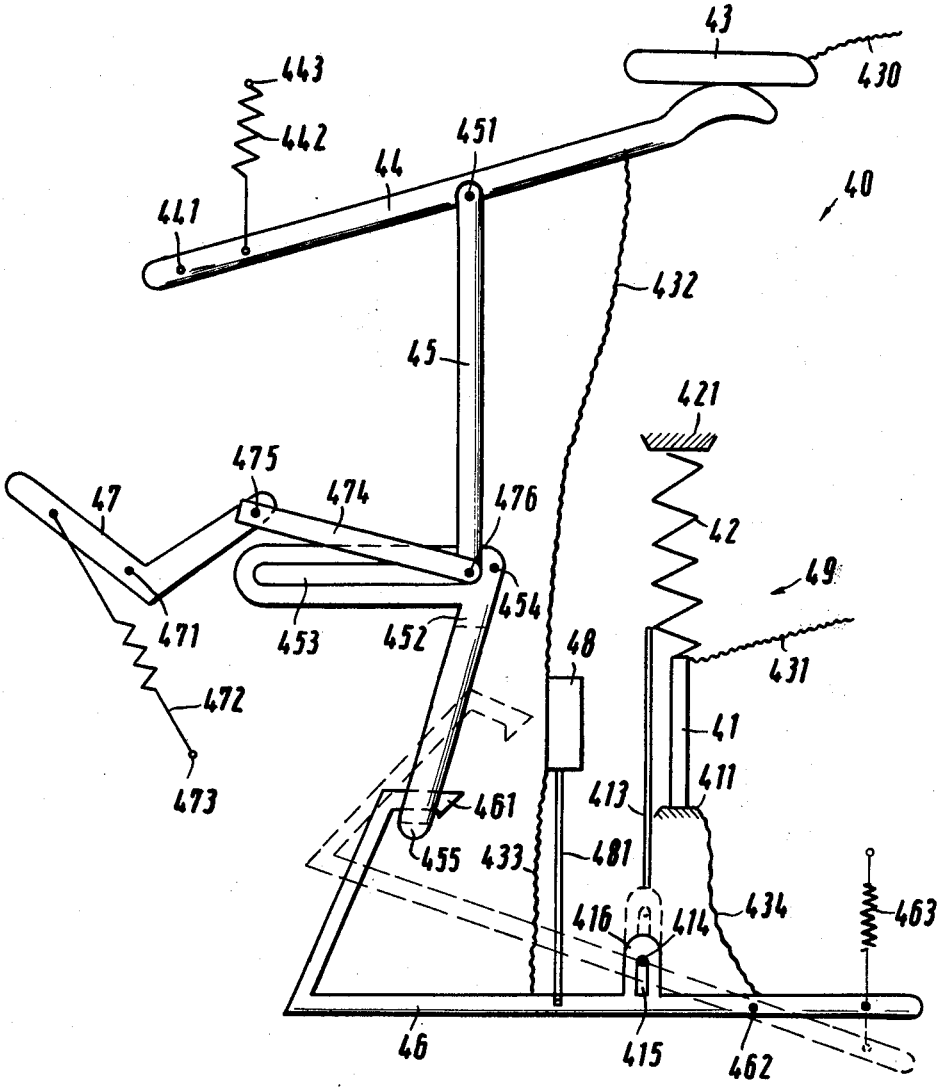
Figure 5:
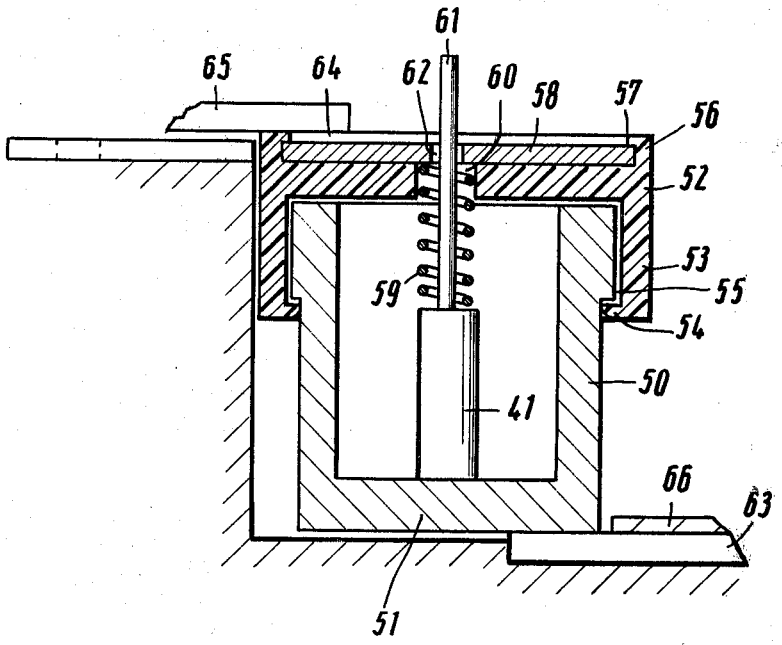

Preferred embodiments and applications of thermal switches according to the invention will now be explained with reference to the drawings where FIGS. 1*a* and 1*b* show the principle of a simple thermal switch in an embodiment suitable also for testing purposes, FIG. 2 is the diagrammatical presentation of a modification of the thermal switch of FIG. 1, FIG. 3 shows schematically, a variant of the thermal switch of FIG. 2, FIG. 4 is the semi-schematic presentation of a thermal switch in a thermoelectric breaker with series fuse and mechanical reinforcement of the switching action;

FIG. 5 is a fragmentary diagrammatic cross-sectional view of a cassette for housing the switching element of the thermal switch.

The thermal switch 10, shown diagrammatically in FIG. 1, consists of an element 11, triggering the switching process, in the form of a coherent ribbon-shaped structure with a length of 67 millimeters and a cross section of 0.05 $mm^2$ of vitreous metal alloy with a composition $Fe_{78}Mo_2B_{20}$ ("Metglas 2605, see above). The upper end of the element 11 is held by a clamp 14. The weight 12 fastened to the lower end of the element 11 serves as the tensioning device cooperating with the element 11 and produces a tension of 400 MPa, i.e. a force which is in no way sufficient for tearing the structure representing the element 11 apart in the vitreous-amorphous state.

If the element 11 is rapidly heated to temperatures of 100° C., 162° C. and 212° C., no changes are found but if the crystallization temperature (295° C.) is exceeded the element breaks at a temperature of 300° C. as shown schematically in FIG. 1*b* by the fragments 111, because the force or tensile stress exerted by the tensioning device 12 on the element 11 is larger than the tensile strength of the alloy in the crystalline state.

The switching function proper can be brought about by the tearing of the element itself, for instance, in the form of interrupting the circuit including the element, or by a change of position that occurs during the rupture, for instance of the weight 12, in a manner known per se, electrically, mechanically or hydraulically and can, if desired, be amplified by mechanical or electrical means. For instance, the clamp 14 and the weight 12 can be part of an electric circuit, not shown, which is interrupted if the element 11 breaks, according to FIG. 1*b*. In this case the Joule heat which is produced in the electrically conducting element 11 if a corresponding amount of current passes through it, can also generate the temperature for the crystallization of the vitreous-amorphous alloy.

The heating-up, however, can also be accomplished by contact of the element 11 with a solid, liquid or gaseous medium and the switching function of the thermal switch 10 can, for instance, be triggered also mechanically, electrically or optically by the falling weight 12.

A thermal switch of the type shown in FIGS. 1*a*, 1*b* is, furthermore, a simple means to determine, for a given vitreous metal alloy, the desirable mechanical and thermal parameters for its use in a thermal switch according to the invention.

The thermal switch 20 shown diagrammatically in FIG. 2 consists of a switch-triggering element 21 in the form of a coherent ribbon as in FIG. 1, the upper end of which is fastened in the holder 24 and the lower end of which engages the tensioning device 22; here a tension spring is fastened at its lower end in the holder 26. As explained in connection with FIGS. 1*a*, 1*b*, the element 21 of the thermal switch 20 breaks if the tension force of the tensioning device 22 acting on the element 21 is larger than the strength of the coherent ribbon like structure used as the element 21 of the metal alloy after its temperature-related conversion from the vitreous-amorphous state into the crystalline state. The thermal switch 20 can again be part of an electric circuit and here, too, the switching function can be triggered in different ways by current interruption or mechanically, for instance by displacing the arm 29 which is fulcrumed at 28 and is connected to the tensioning device 22 into the position shown with broken lines after the element 21 is ruptured, and thereby causes directly or indirectly a change in the switching state.

The thermal switch 30 diagrammatically shown in FIG. 3 again has as a switch triggering element 31 a coherent ribbon-like structure of vitreous-amorphous metal alloy as described above. The two parts 321, 322 of the tensioning device are connected at one end each to a holder 34, 38 and at the other end to the element 31 so that they keep the latter under tension. The parts 321, 322 of the tensioning device can be identical or different power accumulators, for instance, in the form of springs or the like and stress the element 31 with a total force which is sufficient to tear the ribbon-like structure apart in the case of a temperature-caused conversion of the vitreous-amorphous alloy into the crystalline state, and preferably has excess force for reinforcing or accelerating the switching process triggered by the breaking of the element 31.

FIG. 4 shows in a semi-schematic presentation a thermal electric switch 40 such as is known as far as its function is concerned, for protecting electric circuits against current overloads which are increasing slowly or suddenly and which have, instead of a conventional melting fuse, the thermal switch according to the invention together with a conventional resettable series fuse. The switch 40 is connected to the circuit to be protected (not shown) via the lens 430, 431.

In the switched-on condition shown, the current passes from the lead 430 via the fixed contact 43 to the contact arm 44 which can swing about the pivot 441 and is moved by the compression spring 442 and connected at 443 for interrupting the connection to the fixed contact 43, if the support of the contact arm 44 by the thrust arm 45 ceases.

The thrust arm 45 which is connected by the link 451 to the contact arm 44, carries at its lower end a pin, not visible in FIG. 4 which can slide in the cutout 453 of the angle arm 452 to the left if the angle arm 452 is rotated counterclockwise about the linkage 454. However, this rotation is blocked as long as the hookshaped end 461 of the intercept arm 46 rests against the intercept end 455 of the angle arm 452.

The intercept arm 46, pivoted about the joint 462, is held in the position shown in solid lines by the tension spring 463 as long as neither the series fuse 48 nor the thermal switch 49 is activated. If one of the switches 48, 49 goes into operation then the intercept arm 46 is swung clockwise against the action of the spring 463 into the position shown with broken lines and releases the angle arm 452 for rotation in a counterclockwise direction, so that the contact arm 44 is removed from the fixed contact 43 under the action of the spring 442 and the electrical connection between the leads 430, 431 is interrupted. This interrupting switching function can be initiated either by the series fuse 48 or by the thermal switch, both of which are connected to the contact arm 44 and the intercept arm 46 via the connecting lines 432, 433, 434.

The series fuse 48, for instance, a conventional magnetic or bimetal switch which can rotate the intercept arm 46 via a mechanical coupling 481, causes the switch 40 to open if the current flowing through it exceeds a first critical value corresponding to a normal overcurrent. If the angle arm 452 is released by the intercept arm 46 in the event that the series fuse 48 is triggered, the guide pin at the lower end of the thrust arm 45 slides in the cutout 453 to the left; this, in addition to the above-explained removing of the contact arm 44 from the fixed contact 43 also moves the resetting lever 47 about a joint 471, into an "off" position not shown. The resetting lever 47 is under the tension of a spring 472 and is connected via the movable link 475 to the one end of the thrust arm 474, the other end of which is connected by the movable link 476 to the thrust arm 45. If the lower end of the latter with the guide pin is deflected in the cutout 453 to the left and the switch 40 is opened, the resetting lever 47 is moved counterclockwise into the "off" position. However, the switch 40 can be switched on again by means of the resetting lever as soon as the intercept arm 46 has returned upon resetting of the series fuse 48 into that position in which it can engage the end 455 of the angle arm 452.

If the overcurrent flowing through the switch 40 increases so far that it exceeds the second critical value, then the thermal switch 49 goes into action: the overcurrent flowing via the connecting line 431, the tensioning device 42, here designed as a tension spring and the holder 421, through the element 41 and via the connecting line 434 to the intercept arm 46, now heats up the element 41 to the crystallization temperature. Since the tensioning device 42 holds element 41, which is designed as a coherent structure of vitreous metal alloy and is held in the fastening 411, under a force acting as tension which is greater than the tensile strength of the metal alloy in the crystalline state, the element 41 breaks. The lower end of the tensioning device 42 connected to a tie rod 413 springs up and swings the intercept arm 46 around clockwise, overcoming the spring 463. This again releases the angle arm 452; the switch 40 is opened and the resetting lever 47 is brought into the "off" position. Resetting is now no longer possible because the tensioning device 42 holds the intercept arm 46 in the position shown with dotted lines. The lower end of the tie rod 413 is provided with an end piece 414 which is moveable in the elongated cutout 415 of the bracket 416 as long as the thermal switch 49 has not yet been tripped, and the intercept arm 46 is actuated only by the series fuse 48.

It is understood without saying that the design explained with reference to FIG. 4 of a thermo electric breaker with resettable series fuse and not resettable main fuse, using vitreous metal alloys, can be modified considerably without forsaking the advantages attainable according to the invention.

For instance, several resettable series fuses and/or devices can be provided, which facilitate simple exchanging of the main fuse. Furthermore, devices for modifying a mechanical or thermal characteristic of the element of vitreous metal alloy can be used. In general, forces in the Megapascal range can be stored in the tensioning device 42 without disadvantages for extended operation (high creep strength of the vitreous metal alloy of the element 41), where the stored forces are not used up, largely or predominantly, by the breaking of the vitreous alloy of the element 41 when the crystallization temperature and the corresponding change of state is traversed. The so obtainable excess force when the main fuse is tripped makes possible a decisive improvement of the circuit-breaking function, the reliability of interruption and the interruption kinetics of overcurrent fuses which contain a resettable series fuse of any kind and a not resettable main fuse in the form of the new thermal switch. These advantages are obtainable neither with fuses which are based on a solid/liquid change of state nor with fuses which utilize the solid/solid form of memory effect.

It is also possible to accommodate the switching element 41 in a cassette so that it is easily replaceable. Such a cassette arrangement is shown in FIG. 5. The cassette, which in its entirety is designated with the reference numeral 50, has a cup-like lower part 51 of metal which is closed off at its free end by an upper part 52 of insulating plastic. The upper part has arms 53 at the free ends of which projections 54 are formed which engage resiliently behind a shoulder 55 at the lower part and hold in this manner the upper part 52 to the lower part 51. The upper part 52 has on its upper surface a circular extension 56 which is arranged at the rim and at which an inward-pointing collar 57 is formed; the extension 56 together with the collar 57 serves for receiving and holding a metallic plate 58. In the interior of the cassette 50 fastened to the bottom of the lower part 51, the switch tripping element 41 is attached. At the free end of the switch tripping element 41 a tension spring 59 is fastened as the tensioning device which is connected at its other free end to the plate 58, so that a tension force is supplied to the element 41 by the tensioning spring 59. The manner of fastening the spring 59 to the element 41 and to the plate 58 is known per se so that it need not be discussed further here. The spring 59 passes through a cutout 60 at the upper part 52 and the walls of the cutout 60 serve at the same time as guides for the spring.

To the element 41 is further connected an actuating pin 61, also called tripping pin 61, which protrudes through a hole 62 in the metallic plate 58. The free end of the tripping pin 61, protruding to the outside, can be in connection with the intercept arm 46, for instance, in the region of the bracket 416, whereby the tripping rod 61 exerts the same action on the intercept arm 46 as the tie rod 413.

For electrically connecting the element 41 serves a connecting tab 63 or a connecting lead 63 which is in electrically conducting contact with the lower part 51 which consists of metal. The plate 58 is the current-collecting component; it is in connection with a further connecting tab 65 or connecting lead 65 via a contact boss 64. In the inserted or installed and switched-on condition, the current flows via the connecting tab 63 to the metallic lower part which is connected to the element 41 in an electric-metallic manner. The current continues via the spring 59 and the plate 58 to the other connecting tab 65. The upper part 52 serves here for the electrically insulating separation of the metallic plate 58 from the lower part 51.

The cassette 50 with the element 41 is inserted inside an electric breaker, where it is held by the tab 65 and, if applicable, by a mounting part 66 (shown only schematically) which is attached to the housing under spring tension. It is possible of course also to make the bottom of the lower part in such a way that it can be slipped over a guide rail and can be detented on the latter. The cassette 50 may have rectangular or also cylindrical shape; the rectangular or slab-like form will be preferred because the space required can be reduced thereby.

It is also possible to build only the element 41 into the cassette and to arrange the tensioning device outside of the cassette. However, the tensioning device must then be brought into engagement with the element when the cassette with the element is installed. This will have to be done by hand in most cases and is therefore time-consuming, so that it will in most cases be the more advantageous solution to accommodate the element and the tensioning device in the cassette.

There are claimed:

1. Thermal switch, comprising a switching element formed of a coherently structured vitreous metal alloy, said switching element being in a vitreous-amorphous state and having a higher strength at a lower first temperature range, and in a crystalline state and having a lower strength at a higher second temperature range, tensioning means cooperating with said switching element for exerting a force thereon which is sufficient to break said switching element in said crystalline state and insufficient to break said switching element in said vitreous amorphous state, an electrical contact movable between an open and a closed position, latching means for moving to said open position, means for locking said contact in said open position, and a push rod operatively connected from said switching element to said latching means for locking said contact in said open position in response to the breaking of said switching element in the vicinity of a transition from said first to said second temperature range.

2. Thermal switch according to claim 1, wherein said vitreous metal alloy forming said switching element is an undercooled melt of an alloy formed of 65 to 80 atomic percent of the group consisting of at least one of iron and nickel and 18 to 22 atomic percent of the group consisting of at least one of boron and phosphorus.

3. Thermal switch according to claim 2, wherein said vitreous metal alloy further includes at least one of the group consisting of chromium, molybdenum and aluminum.

4. Thermal switch according to claim 3, wherein said vitreous metal alloy contains 14 atomic percent chromium, 2 atomic percent molybdenum and 3 atomic percent aluminum.

5. Thermal switch according to claim 1, wherein said vitreous metal alloy forming said switching element is an undercooled melt of beryllium, zirconium and titanium.

6. Thermal switch according to claim 5, wherein said vitreous metal alloy contains approximately 40 atomic percent beryllium, 10 atomic percent zirconium and 50 atomic percent titanium.

7. Thermal switch according to claim 1, wherein said coherently structured switching element is a ribbon.

8. Thermal switch according to claim 1, wherein said tensioning means exerts a force, measured in Megapascals, which is from 30 to 90% of the tensile strength, measured in Megapascals, of said metal alloy in said vitreous-amorphous state.

9. Thermal switch according to claim 8, wherein said tensioning means exerts a force which is from 50 to 75% of said tensile strength of said metal alloy in said vitreous-amorphous state.

10. Thermal switch according to claim 1, wherein said tensioning means is a spring.

11. Thermal switch according to claim 1, wherein said tensioning means is a weight.

12. Thermal switch according to claim 1, including an exchangeable cassette, said switching element being mounted in said cassette.

13. Thermal switch according to claim 12, wherein said tensioning means is disposed in said cassette.

14. Thermal switch according to claim 13, wherein said cassette comprises a metallic cup-shaped lower part, an upper part removably closing off said lower part, said upper part being formed of insulating plastic and having an upper surface, a metallic plate fastened to said upper surface of said upper part, a current lead connected to said lower part and a further current lead connected to said metallic plate, said switching element having one end thereof attached to said lower part and another end thereof attached to one end of said tensioning means, another end of said tensioning means being attached to said metallic plate, said metallic plate being electrically and metallically connected to said lower part exclusively through said tensioning means and switching element.

15. Thermal switch according to claim 14, wherein said current leads are spring-biased against said lower part and metallic plate, respectively.

16. Thermal switch according to claim 14, wherein said current leads are screwed to said lower part and metallic plate, respectively.

17. Thermal switch according to claim 15, wherein said push rod is a plastic tripping pin for opening a switching gap, said pin having one end fastened to said other end of said switching element and another end protruding outside said cassette.

18. Thermal switch according to claim 16, wherein said push rod is a plastic tripping pin for opening a switching gap, said pin having one end fastened to said other end of said switching element and another end protruding outside said cassette.

19. Thermal switch according to claim 17, wherein said pin protrudes through cutouts formed in said upper part and metallic plate, said cutout in said upper part having said other end of said tensioning means disposed therein, and said cut-out in said metallic plate being smaller than said other end of said tensioning means.

20. Thermal switch according to claim 18, wherein said pin protrudes through cutouts formed in said upper part and metallic plate, said cutout in said upper part having said other end of said tensioning means disposed therein, and said cut-out in said metallic plate being smaller than said other end of said tensioning means.

21. Thermal switch according to claim 12, including a circuit breaker, said lower part of said cassette being disposed in said circuit breaker.

22. Method for protecting electric circuits against overcurrents, which comprises triggering a resettable series fuse in response to normal overcurrents, triggering a non-resettable main fuse in response to abnormal overcurrents by tensioning a coherently structured vitreous metallic alloy switching element, having a vitreous-amorphous state and higher strength at a lower temperature range and a crystalline state and lower strength at a higher temperature range, with a force which is sufficient to break the switching element in the crystalline state and insufficient to break the switching element in the vitreous-amorphous state, activating a latching device in response to the triggering of either fuse, opening an electrical contact in the circuit upon activation of the latching device, and locking the contact in the open position upon the triggering of the main fuse.

23. Method according to claim 22, wherein said vitreous metal alloy forming said switching element is an undercooled melt of an alloy formed of 65 to 80 atomic percent of the group consisting of at least one of iron and nickel and 18 to 22 atomic percent of the group consisting of at least one of boron and phosphorus.

24. Method according to claim 23, wherein said vitreous metal alloy further includes at least one of the group consisting of chromium, molybdenum and aluminum.

25. Method according to claim 24, wherein said vitreous metal alloy contains 14 atomic percent chromium, 2 atomic percent molybdenum and 3 atomic percent aluminum.

26. Method according to claim 22, wherein the tensioning means exerts a force, measured in Megapascals, which is from 30 to 90% of the tensile strength, measured in Megapascals, of the metal alloy in the vitreous-amorphous state.

27. Method according to claim 26, wherein the tensioning means exerts a force which is from 50 to 75% of the tensile strength of the metal alloy in the vitreous-amorphous state.

28. Thermal switch according to claim 1, wherein said latching means is movable from an on position to a first off position where said latching means exclusively is activated, and to a second off position where said latching and locking means are both actuated, and including a resettable fuse connected in series with said switching element, said fuse being triggerable at an overcurrent value which is reached before said lower first temperature range is reached, and another push rod connected from said fuse to said latching means for moving said latching means to said first off position, said latching means being movable to said second off position upon breaking of said switching element.

* * * * *